US009665053B2

(12) United States Patent
Mori

(10) Patent No.: US 9,665,053 B2
(45) Date of Patent: May 30, 2017

(54) IMAGE FORMING APPARATUS WITH AN EXTENSION FOR A MANUAL FEED TRAY

(71) Applicant: FUJI XEROX CO., LTD., Tokyo (JP)

(72) Inventor: Takuya Mori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/045,365

(22) Filed: Feb. 17, 2016

(65) Prior Publication Data

US 2017/0052504 A1 Feb. 23, 2017

(30) Foreign Application Priority Data

Aug. 20, 2015 (JP) ..... 2015-162649

(51) Int. Cl.
*G03G 15/00* (2006.01)

(52) U.S. Cl.
CPC ..... *G03G 15/6514* (2013.01); *B65H 2405/11164* (2013.01); *G03G 2215/00392* (2013.01)

(58) Field of Classification Search
CPC ..... G03G 15/6514; G03G 2215/00392; G03G 2221/169; B65H 2405/11164; B65H 2405/1117; B65H 2405/11172; B41J 13/103
See application file for complete search history.

(56) References Cited

U.S. PATENT DOCUMENTS

| | | | | |
|---|---|---|---|---|
| 7,395,991 | B2 * | 7/2008 | Kuo | B65H 1/00 248/125.9 |
| 7,748,691 | B2 * | 7/2010 | Mizuguchi | B65H 1/04 271/162 |
| 8,757,794 | B2 | 6/2014 | Takemura et al. | |
| 9,409,734 | B2 * | 8/2016 | Tahara | B65H 3/44 |

FOREIGN PATENT DOCUMENTS

| | | |
|---|---|---|
| JP | 05-004727 A | 1/1993 |
| JP | 2013-039797 A | 2/2013 |

* cited by examiner

*Primary Examiner* — Justin Olamit
(74) *Attorney, Agent, or Firm* — Sughrue Mion, PLLC

(57) ABSTRACT

An image forming apparatus includes an opening and closing unit attached to an image forming apparatus body. The opening and closing unit includes: an exterior member pivotably attached to the image forming apparatus body via a first shaft; a base member provided inside the exterior member and pivotably attached to the image forming apparatus body via a second shaft so as to be able to move with the exterior member; and an extension member attached to the base member in a manner capable of being pulled out and retracted.

4 Claims, 13 Drawing Sheets

IMAGE FORMING APPARATUS WITH AN EXTENSION FOR A MANUAL FEED TRAY

CROSS-REFERENCE TO RELATED APPLICATIONS

This application is based on and claims priority under 35 USC 119 from Japanese Patent Application No. 2015-162649 filed Aug. 20, 2015.

BACKGROUND

Technical Field

The present invention relates to image forming apparatuses.

SUMMARY

According to an aspect of the invention, there is provided an image forming apparatus including an opening and closing unit attached to an image forming apparatus body. The opening and closing unit includes an exterior member pivotably attached to the image forming apparatus body via a first shaft; a base member provided inside the exterior member and pivotably attached to the image forming apparatus body via a second shaft so as to be able to move with the exterior member; and an extension member attached to the base member in a manner capable of being pulled out and retracted.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings. Note that the exemplary embodiments described below show examples of an opening and closing unit and an image forming apparatus for embodying a technical idea of the present invention and are not intended to limit the present invention to such embodiments, and the exemplary embodiments described below are equally applicable to other exemplary embodiments included in the scope of the claims.

First Exemplary Embodiment

Figure 1:
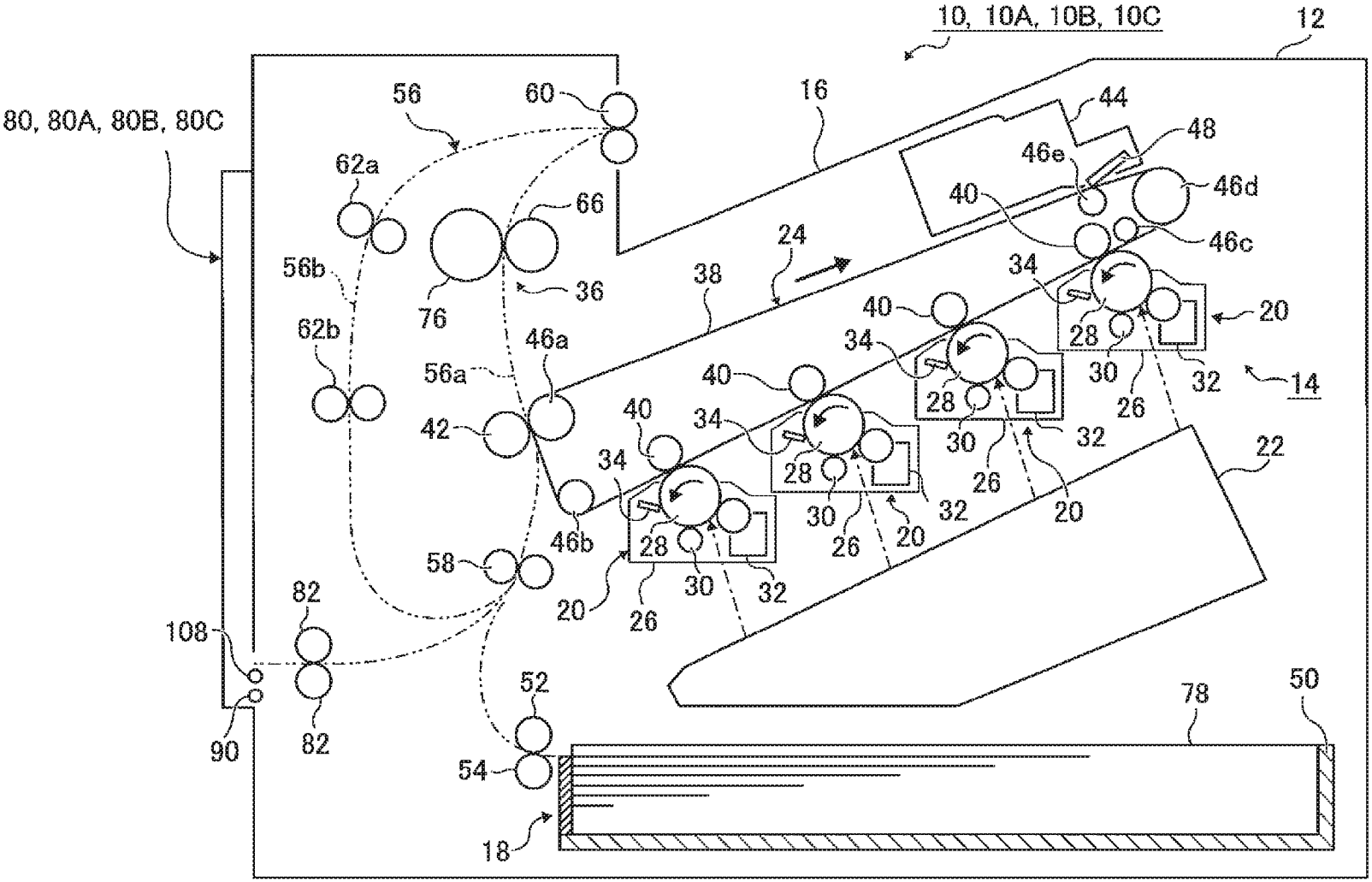
FIG. 1 is a side sectional view of an image forming apparatus according to first to fourth exemplary embodiments.

Referring to FIGS. 1 to 5, an image forming apparatus 10 having a manual feed unit 80, serving as an opening and closing unit, according to a first exemplary embodiment will be described below. As shown in FIG. 1, the image forming apparatus 10 according to the first exemplary embodiment has an image forming apparatus body 12. The image forming apparatus body 12 accommodates a recording-medium feed device 18 that feeds a recording medium 78, such as recording paper, serving as a material to which an image is transferred; an image forming unit 14 that forms an image to be transferred to the recording medium 78; and a fixing device 36 are mounted, and has, at the top, a discharge part 16, on which the recording medium 78 is discharged. A transport path 56, which transports the recording medium 78, is provided so as to pass through the aforementioned devices and units. The configurations of these devices and units will be described below.

Figure 2A:
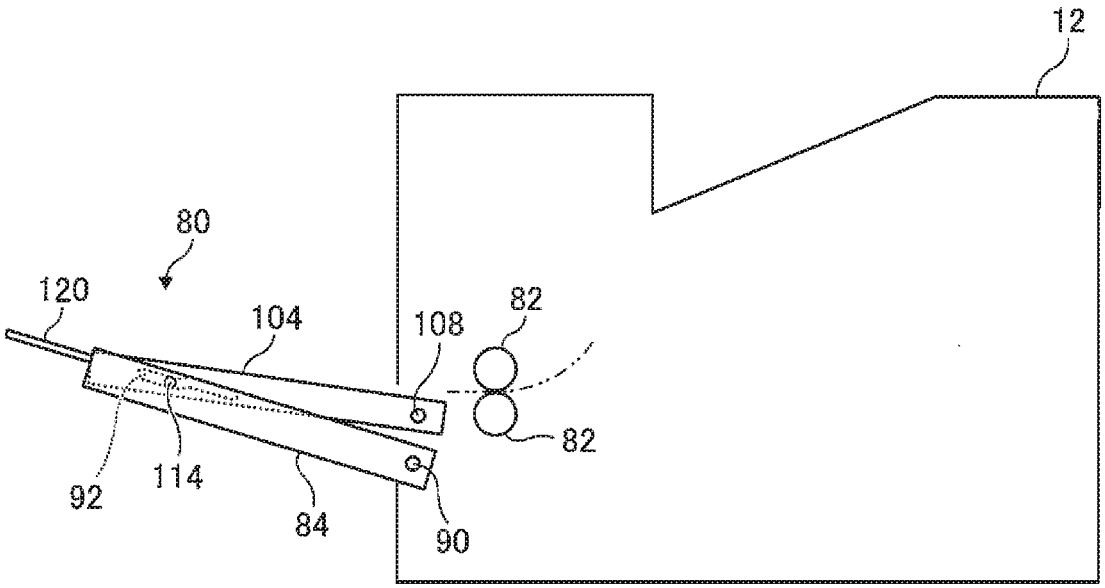
FIGS. 2A and 2B are schematic side sectional views showing a state in which a manual feed unit is open and a state in which the manual feed unit is closed, respectively.
Figure 2B:
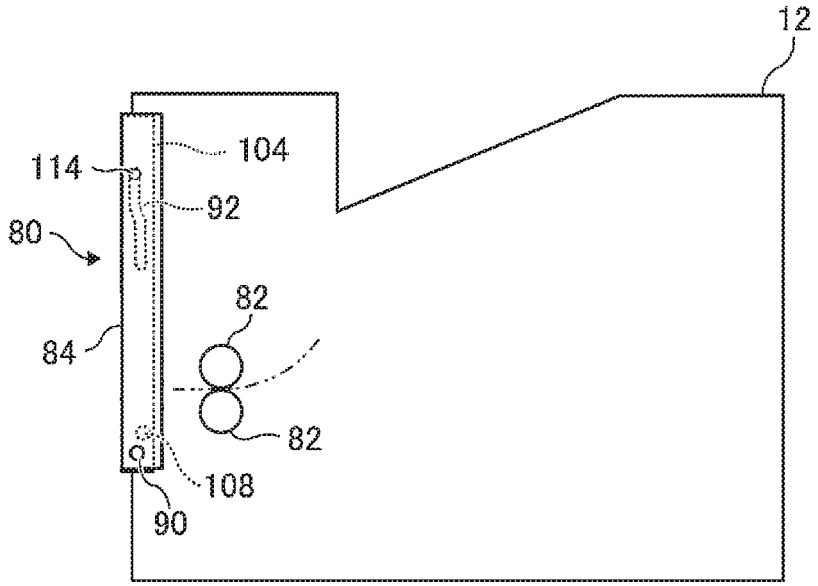

A manual feed unit 80, serving as an opening and closing unit, is provided on a side surface (i.e., the left side surface in FIGS. 1 and 2) of the image forming apparatus body 12. This manual feed unit is supported onto the image forming apparatus body 12 via two shafts 90 and 108 in a manner capable of being opened and closed. When the manual feed unit 80 is open, as shown in FIG. 2A, a recording medium 78 to be fed is placed on the manual feed unit 80, and when the manual feed unit 80 is closed, as shown in FIG. 2B, the manual feed unit 80 is stored in the side surface of the image forming apparatus body 12. The manual feed unit 80 will be described below.

The recording-medium feed device 18 includes a recording medium storage container 50 that stores a stack of recording media 78, a transport roller 52 that picks up a recording medium 78 at the top of the stack stored in the recording medium storage container 50 and transports the recording medium 78 toward the image forming unit 14, and a retard roller 54 that separates the recording media 78 into individual sheets to prevent more than one recording medium 78 from being transported to the image forming unit 14 in a stacked manner.

The image forming unit 14 includes image forming units 20 corresponding to, for example, four colors, namely, yellow (Y), magenta (M), cyan (C), and black (K); a light writing device 22; and a transfer device 24. The image forming units 20 and the components thereof have the same configurations except for the colors of the images formed.

The image forming units 20, serving as replaceable members, are removably attached to the image forming apparatus body 12. The image forming units 20 corresponding to Y, M, C, and K are arranged in this order from the rear side (i.e., the right side in FIG. 1) of the image forming apparatus body 12.

The image forming units 20 use, for example, an electrophotographic system for forming color images. The image forming units 20 each include an image forming unit body 26, which accommodates a drum-shaped image carrier 28, which supports a developer image; a charging device 30, serving as a charging unit, having a charging roller for uniformly charging the image carrier 28; a developing device 32 that develops a latent image written on the image carrier 28 with developer (toner); and a cleaning device 34 that removes waste developer remaining on the image carrier 28 by, for example, scraping off.

The developing devices 32 develop latent images formed on the corresponding image carriers 28, using Y, M, C, and K developers accommodated therein.

Furthermore, the light writing device 22, serving as a latent-image forming device, is formed of, for example, a scanning laser exposure device and forms a latent image on the surface of each image carrier 28. In another exemplary embodiment, the light writing device 22 may employ an LED, a surface emitting laser, or the like.

The transfer device 24 is formed of a transfer-receiving member 38, serving as a transfer body; first transfer rollers 40, serving as a first transfer device; a second transfer roller 42, serving as a second transfer device; and a cleaning device 44.

The transfer-receiving member 38 has the shape of, for example, an endless belt and is supported by five support rollers 46*a*, 46*b*, 46*c*, 46*d*, and 46*e* so as to be able to revolve in the direction indicated by the arrow in FIG. 1. At least one of the support rollers 46*a*, 46*b*, 46*c*, 46*d*, and 46*e* is coupled to a power source (not shown), such as a motor, and is rotated by a driving force from the power source, whereby the transfer-receiving member 38 is revolved.

A support roller 46*a* is provided so as to oppose the second transfer roller 42 and functions as a backup roller for the second transfer roller 42. A portion nipped between the second transfer roller 42 and the support roller 46*a* forms a second transfer position.

The first transfer rollers 40 transfer developer images formed on the surfaces of the image carriers 28 by the corresponding developing devices 32 to the transfer-receiving member 38.

The second transfer roller 42 transfers the Y, M, C, and K developer images transferred to the transfer-receiving member 38 to the recording medium 78.

The cleaning device 44 includes a scraper 48 that scrapes off color the developer remaining on the surface of the transfer-receiving member 38 after the color developer images have been transferred to the recording medium 78 by the second transfer roller 42. The developer scraped off by the scraper 48 is recovered in the body of the cleaning device 44.

The transport path 56 is formed of a principal transport path 56*a* and a reversing transport path 56*b*.

The principal transport path 56*a* transports a recording medium 78, fed from the recording-medium feed device 18, to the image forming unit 14 and discharges the recording medium 78, having an image formed thereon, onto the discharge part 16. The transport roller 52, the retard roller 54, registration rollers 58, the transfer device 24, the fixing device 36, and discharge rollers 60 are arranged along this principal transport path 56*a*, in this order from the upstream side in the transport direction of the recording medium 78.

The registration rollers 58 temporarily stop the leading end of the recording medium 78 transported from the recording-medium feed device 18 and send the recording medium 78 toward the transfer device 24, in accordance with the timing of image formation.

The fixing device 36 includes a heating roller 66, serving as a heating part, and a pressure part 76. By applying heat and pressure to the recording medium 78 passing between the heating roller 66 and the pressure part 76, the developer image is fixed to the recording medium 78.

The discharge rollers 60 discharge the recording medium 78, to which the developer has been fixed by the fixing device 36, onto the discharge part 16.

The reversing transport path 56*b* is a transport path in which the recording medium 78 having the developer image formed on one surface thereof is reversed and fed again to the image forming unit 14. The reversing transport path 56*b* has, for example, two reversing transport rollers 62*a* and 62*b*.

When the discharge rollers 60 are reversely rotated with the trailing end of the recording medium 78 transported from the principal transport path 56*a* to the discharge rollers 60 nipped between the discharge rollers 60, the recording medium 78 is fed to the reversing transport path 56*b*. The recording medium 78 fed to the reversing transport path 56*b* is transported to a position upstream of the registration rollers 58 by the reversing transport rollers 62*a* and 62*b*.

A recording medium 78 placed on the manual feed unit 80 is fed out by the manual-feed pick-up rollers 82, passes through the registration rollers 58, the transfer device 24, and the fixing device 36, and is discharged onto the discharge part 16, similarly to the above-described recording medium 78 fed out by the recording-medium feed device 18.

Figure 3:
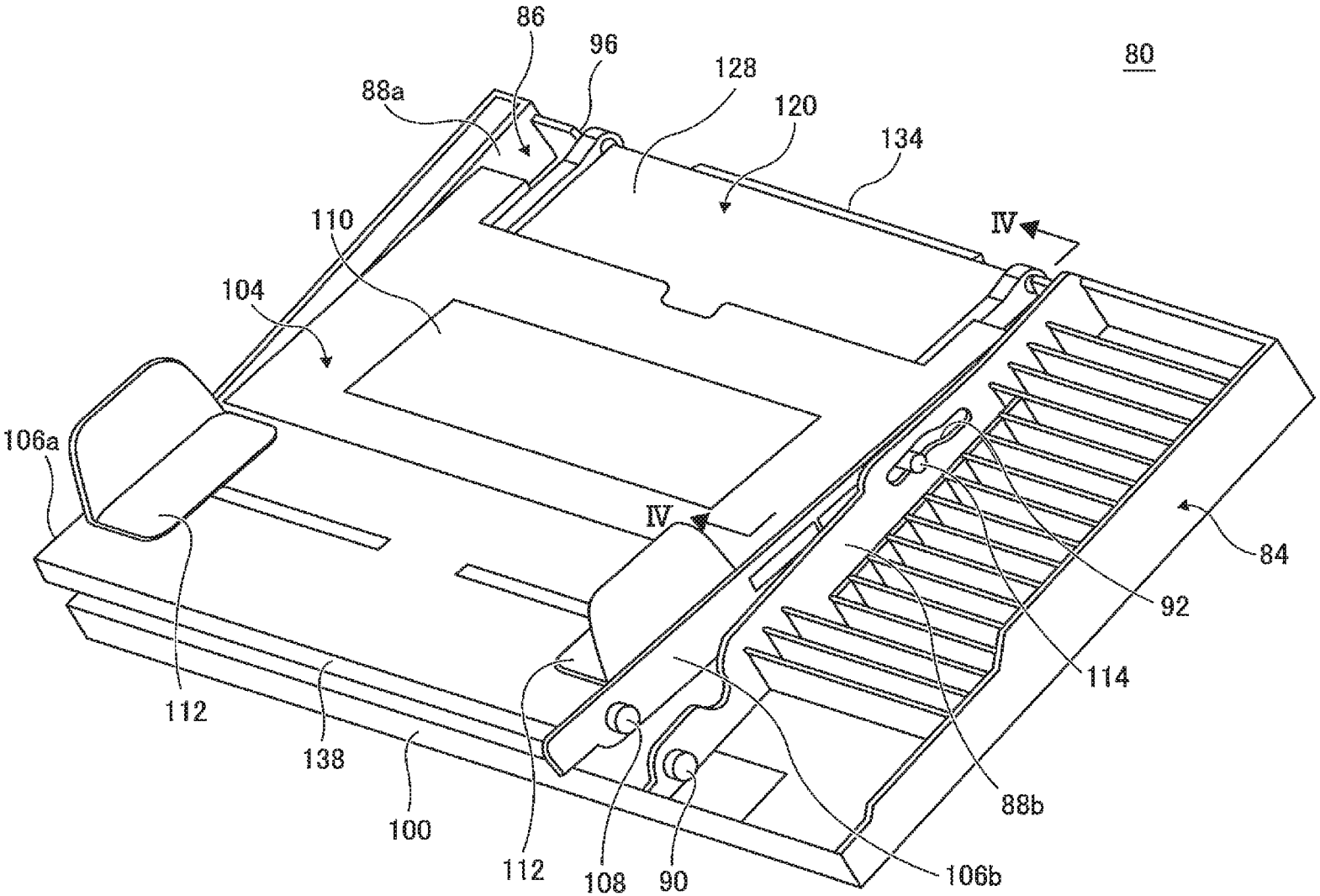
FIG. 3 is a perspective view of the manual feed unit according to the first exemplary embodiment.
Figure 4:
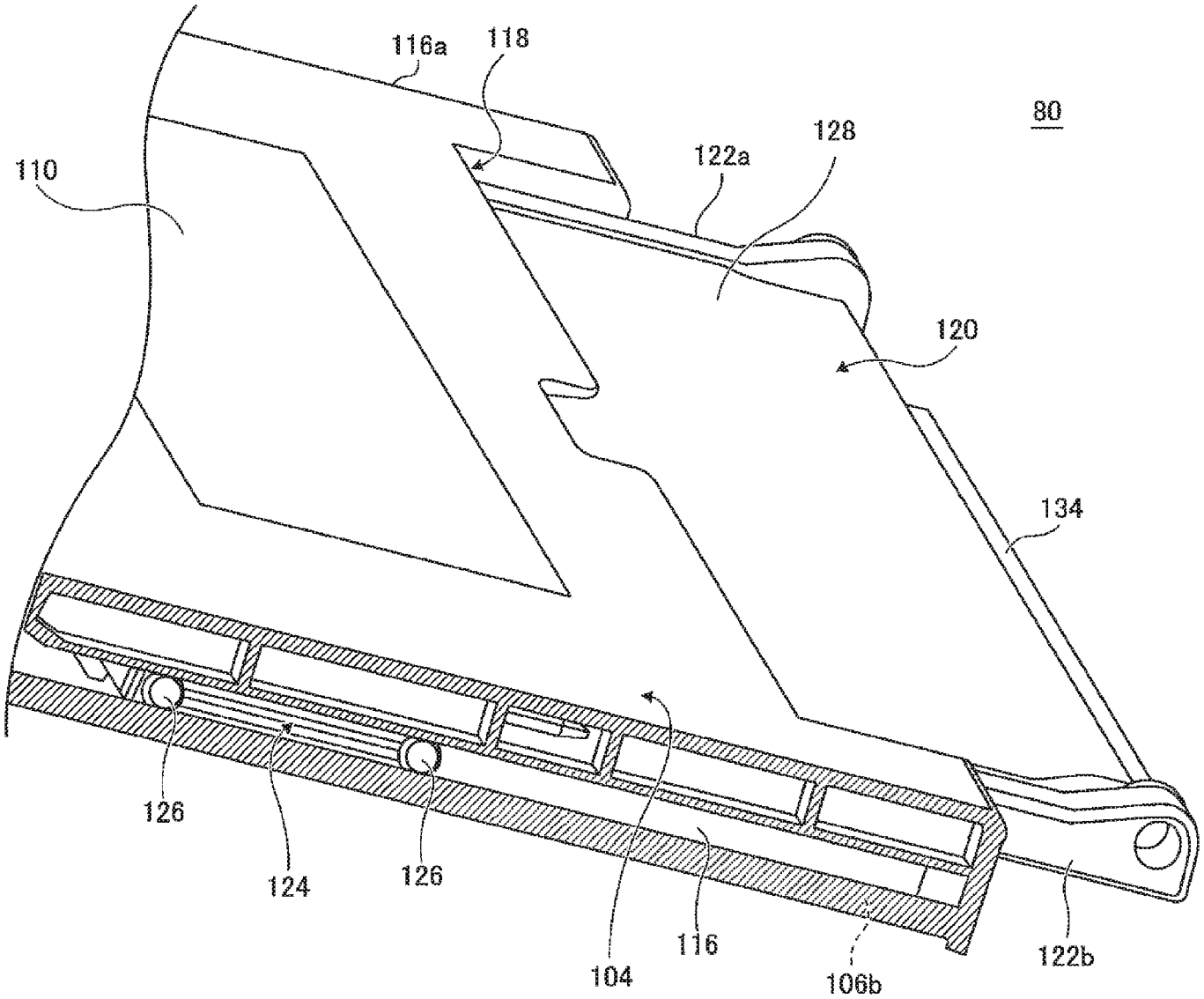
FIG. 4 is a perspective sectional view taken along line IV-IV in FIG. 3, without an exterior member.

Next, the manual feed unit 80 will be described. The manual feed unit 80 according to the first exemplary embodiment includes, as shown in FIGS. 2 and 3, an exterior member 84 provided on the side surface of the image forming apparatus body 12, a base member 104 on which a recording medium 78 is placed, and an extension member 120 accommodated in the base member 104 in a manner capable of being pulled out and retracted.

The exterior member 84 and the base member 104 are attached to the image forming apparatus body 12 via different shafts, thus having a double-shaft configuration in which the exterior member 84 and the base member 104 pivot about different fulcrums. The exterior member 84 and the base member 104 are configured such that, when the exterior member 84 is operated, the base member 104 moves with the exterior member 84, and are freely opened and closed. A recording medium 78 placed on the base member 104 is picked up by rotating manual-feed pick-up rollers 82, provided in the image forming apparatus body 12, and is transported.

The base member 104 of the manual feed unit 80 according to the first exemplary embodiment is provided with the extension member 120. The extension member 120 is accommodated in the base member 104 in a manner capable of being pulled out and retracted in the direction in which the recording medium 78 is transported. By pulling out the extension member 120, a recording medium 78 longer than the base member 104 may be placed.

The exterior member 84 is formed in the shape of a box having a predetermined area that covers the side surface of the image forming apparatus body 12. The exterior member 84 has, at a portion adjacent to the image forming apparatus body 12, an accommodating space 86 in which the base member 104 is accommodated. The accommodating space 86 is delimited by a wall 88*a* and another wall 88*b* formed at ends and standing upright. These walls 88*a* and 88*b* are each provided with the first shaft 90, which is rotatably attached to the image forming apparatus body 12.

Furthermore, the walls 88*a* and 88*b* are each provided with a slot 92 that allows the base member 104, disposed in the accommodating space 86, to move in a state attached to the exterior member 84. The slot 92 is formed in a partially inclined shape, so that the exterior member 84 and the base member 104, which pivot about different shafts, may be moved in an attached state when the manual feed unit 80 is opened and closed.

Figure 5:
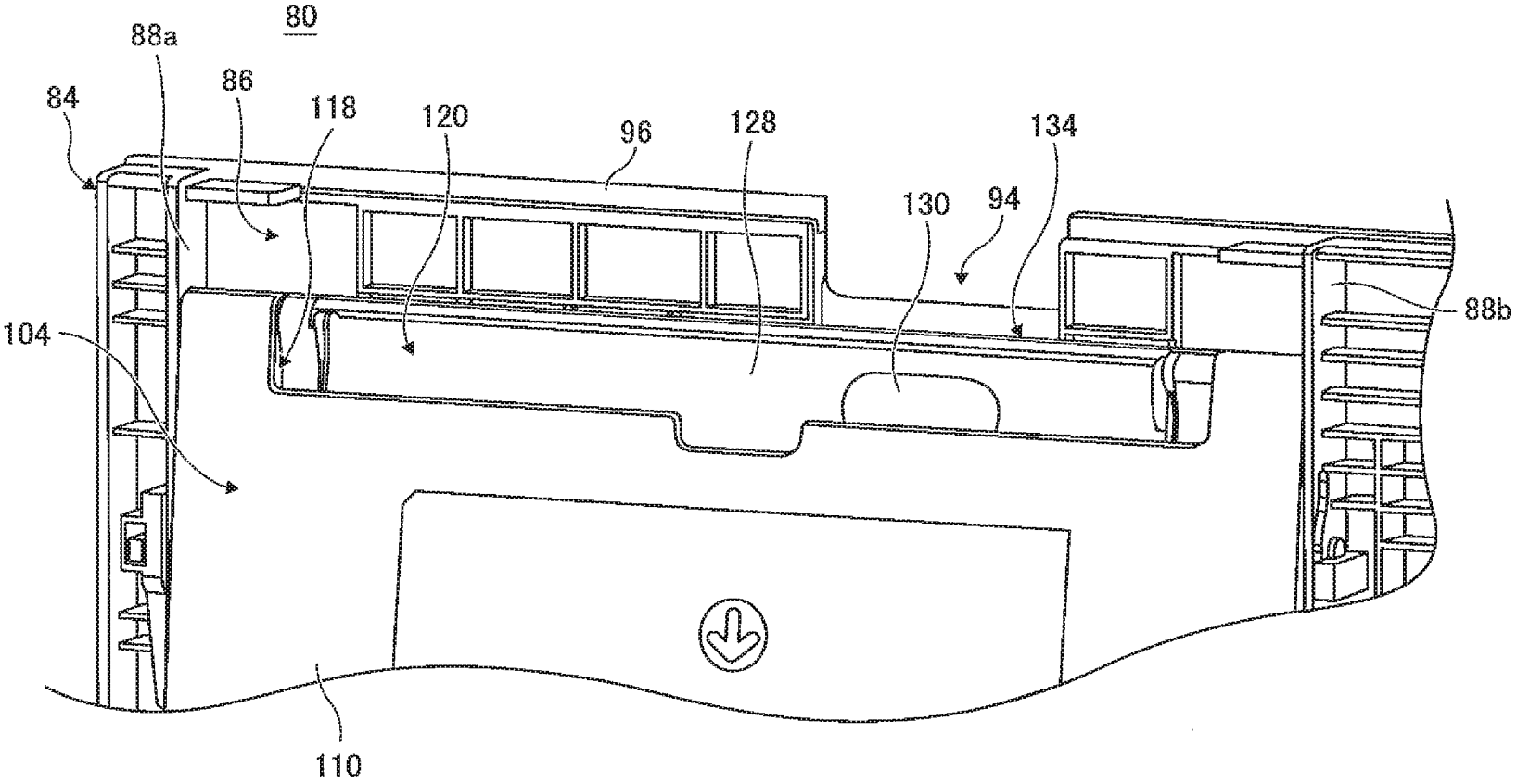
FIG. 5 is a perspective view showing a manipulating hole provided in an extension member according to the first exemplary embodiment.

Furthermore, the exterior member 84 is provided with a cut-away portion 94 at a side from which the extension member 120 is pulled out (see FIG. 5).

The base member 104 is formed in the shape of a plate having a size capable of being accommodated in the accommodating space 86 in the exterior member 84. The surface of the base member 104 adjacent to the image forming apparatus body 12 serves as a recording-medium mounting part 110, on which the recording medium 78 is placed. The recording-medium mounting part 110 is provided with adjuster members 112 that may be moved according to the size of the recording medium 78 used. By moving the adjuster members 112, the position of the recording medium 78 is adjusted.

Furthermore, a side surface 106*a* and another side surface 106*b* of the base member 104 are each provided with a second shaft 108, which is rotatably attached to the image forming apparatus body 12. The side surfaces 106*a* and 106*b* are also provided with projections 114, which are fitted to the slots 92, provided in the exterior member 84, in a movable manner. When the manual feed unit 80 is opened and closed, the projections 114 provided on the base member 104 slide in the slots 92 in the exterior member 84, enabling smooth opening and closing.

The base member 104 also has, therein, an extension-member provision portion 118 to which the extension member 120 is attached. This extension-member provision portion 118 is surrounded by the back surface of the recording-medium mounting part 110 and the side surfaces 106*a* and 106*b* of the base member 104. Furthermore, the side surfaces 106*a* and 106*b* of the base member 104 are each provided with a guide slot 116, in which the extension member 120 moves in a guided manner. These guide slots 116 are formed linearly, so as to extend in the direction in which the extension member 120 is moved. These guide slots 116 receive guide members 124 (described below) formed on the extension member 120.

The extension member 120 is formed in the shape of a plate having a size capable of being accommodated in the extension-member provision portion 118 of the base member 104 so as to be able to move. This extension member 120 has, on the side adjacent to the image forming apparatus body 12, an extension recording-medium mounting part 128, on which the recording medium 78 is placed. When the extension recording-medium mounting part 128 and the recording-medium mounting part 110 of the base member 104 form a flat surface, a long recording medium may be placed thereon.

A side wall 122*a* and another side wall 122*b* of the extension member 120 are each provided with the guide member 124 formed along the guide slot 116 and fitted to the guide slot 116 in the base member 104 so as to be able to move. The guide member 124 according to the first exemplary embodiment has guide projections 126 provided at the front and rear ends in the moving direction. This configuration allows the extension member 120 to move linearly, without rotating.

Furthermore, a manipulating hole 130, serving as a manipulating portion, into which a user's finger is inserted, is provided in the extension member 120, on the extension recording-medium mounting part 128 side, at a portion corresponding to the cut-away portion 94 in the exterior member 84.

The operation of the manual feed unit 80 according to the first exemplary embodiment will be described. By pulling the exterior member 84 in a direction away from the image forming apparatus body 12, the manual feed unit 80 is pivoted about the first shaft 90 of the exterior member 84 and the second shaft 108 of the base member 104 and is opened, thereby allowing a recording medium 78 to be placed on the recording-medium mounting part 110 of the base member 104. At this time, the projections 114 formed on the base member 104 move in the slots 92 provided in the exterior member 84, allowing the exterior member 84 and the base member 104 to be opened in an attached state.

Thereafter, by pulling the extension member 120 out of the base member 104, the extension member 120 is pulled out, and the recording-medium mounting part 110 of the base member 104 and the extension recording-medium mounting part 128 of the extension member 120 are arranged in a flat surface. At this time, a user may easily pull out the extension member 120 by inserting the finger into the manipulating hole 130 provided at a portion corresponding to the cut-away portion 94 formed in the exterior member 84. More specifically, in a state in which the manual feed unit 80 is open, the ends of the exterior member 84 and base member 104 are located at different positions (i.e., the base member 104 is located below the exterior member 84), because the exterior member 84 and the base member 104 pivot about different fulcrums. Hence, without the manipulating hole, it is difficult to pull out the extension member 120. However, in the first exemplary embodiment, by providing the manipulating hole 130, the extension member 120 is easily pulled out.

Furthermore, by providing the extension member 120 in the base member 104, a linear movement is possible. Thus, compared with a case where the extension member 120 is moved along a curved path, the extension member 120 is smoothly pulled out.

Modification

Figure 6:
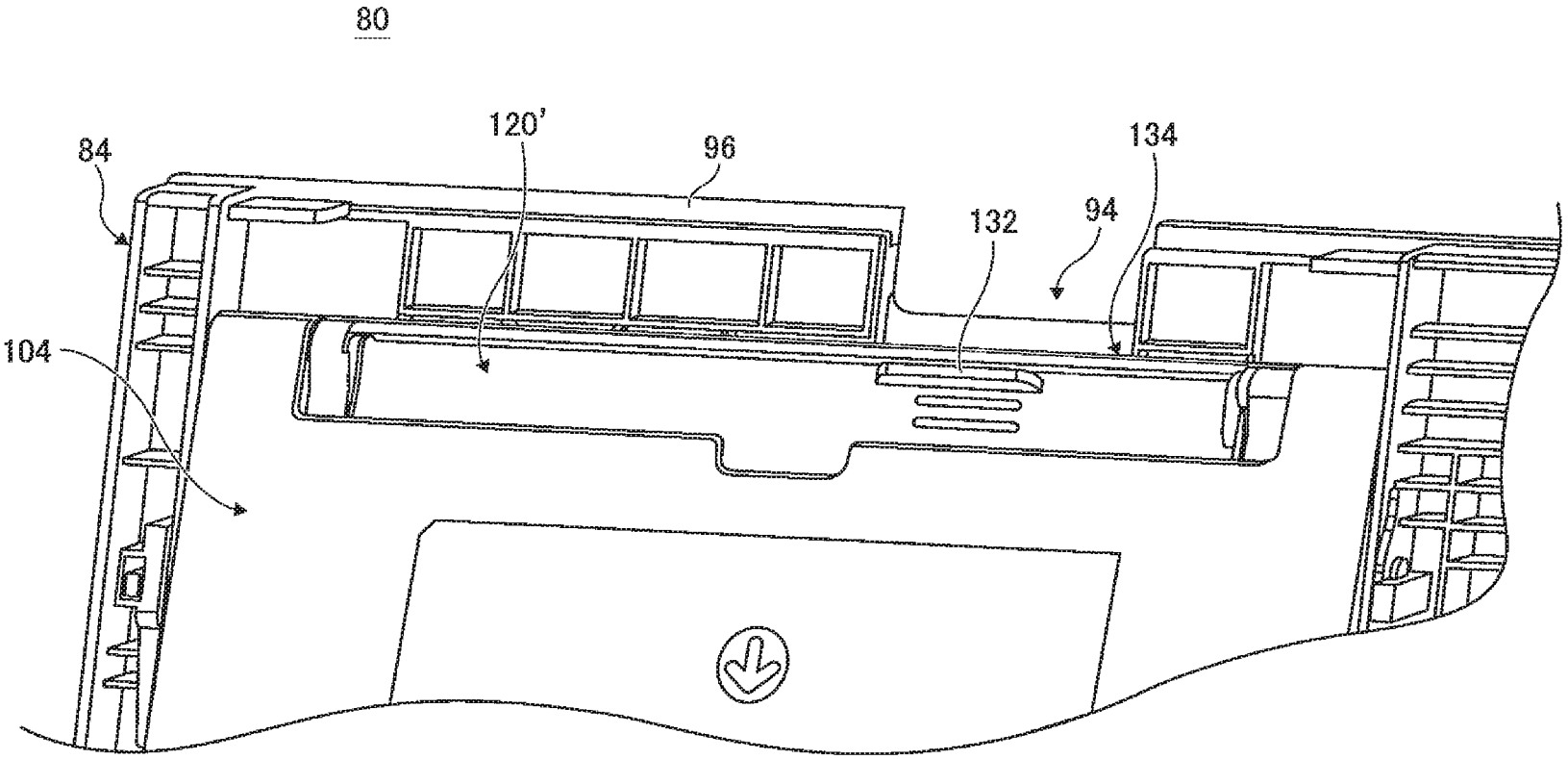
FIG. 6 is a perspective view of a manipulating projection provided on the extension member according to a modification of the first exemplary embodiment.

Although the manipulating hole 130 is provided in the extension recording-medium mounting part 128 of the extension member 120 according to the first exemplary embodiment, instead, a manipulating projection 132, serving as a manipulating portion, may be provided in an extension member 120', as shown in FIG. 6. This manipulating projection 132 also allows a user to hold with a finger to pull out the extension member 120', making a pulling out operation easy.

Second Exemplary Embodiment

The manual feed unit 80 of the image forming apparatus 10 according to the first exemplary embodiment is configured such that the extension member 120 is located below a distal end 96 of the exterior member 84, when the exterior member 84 is opened. A manual feed unit 80A of an image forming apparatus 10A according to a second exemplary embodiment is configured such that the extension member 120A is engaged with the distal end 96 of the exterior member 84. Because the manual feed unit 80A according to the second exemplary embodiment differs from the manual feed unit 80 according to the first exemplary embodiment only in the configuration of part of the exterior member and extension member, the components common to those according to the first exemplary embodiment will be denoted by the same reference signs, and detailed descriptions thereof will be omitted.

The manual feed unit 80A of the image forming apparatus 10A according to the second exemplary embodiment will be described primarily with reference to FIGS. 7 to 10, and also to the drawings used in the description of the first exemplary embodiment. As shown in FIGS. 8 and 9, a first engaging part 98 projecting toward the base member 104 is formed on an exterior member 84A of the second exemplary embodiment, at the distal end 96 opposite from the first shaft 90. This first engaging part 98 is formed perpendicularly to the exterior member 84A. The first engaging part 98 is not formed on the cut-away portion 94 provided in the exterior member 84A, and that portion is open (see FIG. 10). Furthermore, the first engaging part 98 is formed inward of the distal end of the exterior member 84A, and a second engaging part 136 (described below) of the extension member 120A is located between the first engaging part 98 and the distal end 96 of the exterior member 84A. Thus, when the manual feed unit 80A is closed, the extension member 120A is stored properly, without projecting out.

Figure 7:
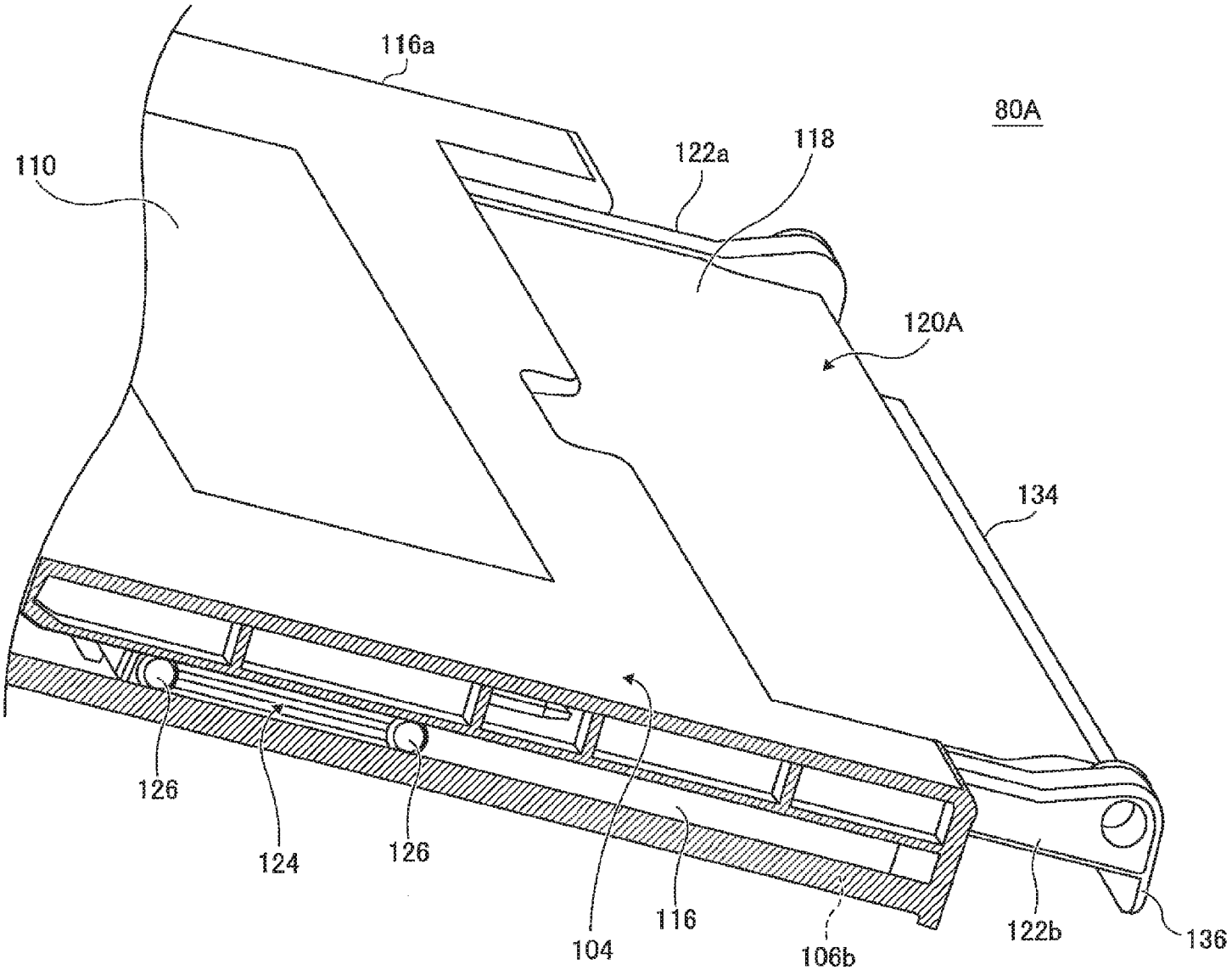
FIG. 7 is a perspective view of a manual feed unit according to the second exemplary embodiment, corresponding to FIG. 4.
Figure 8:
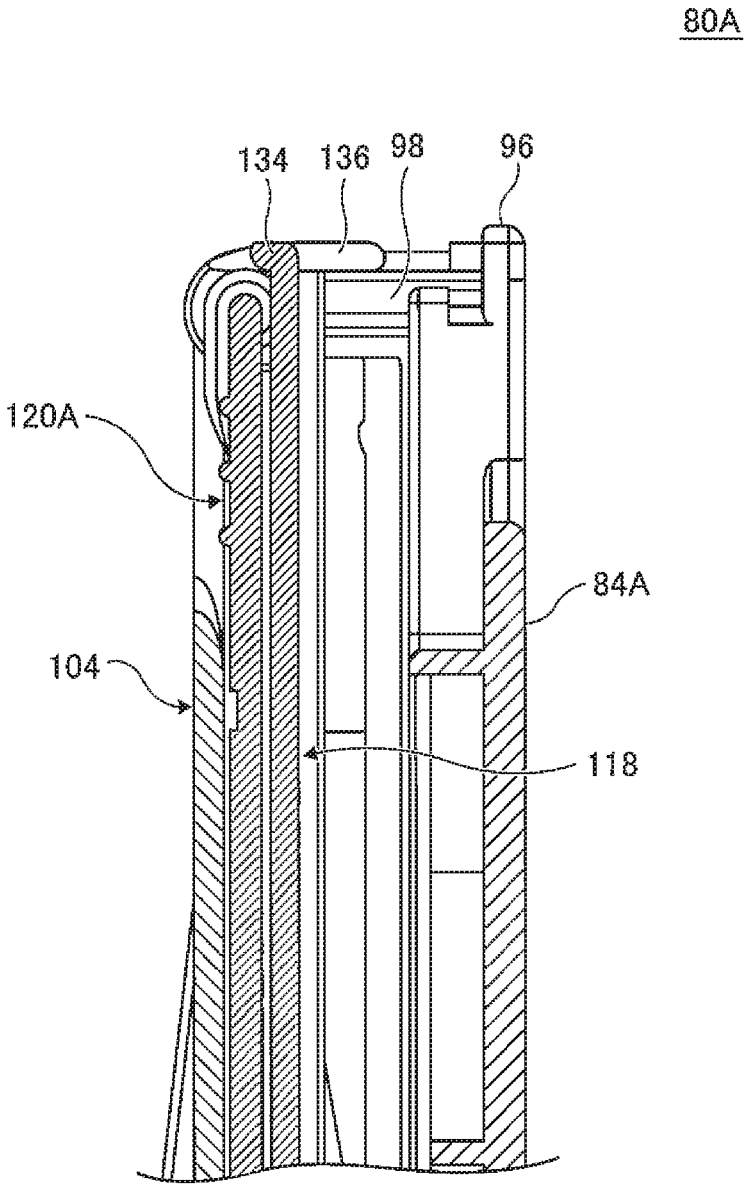
FIG. 8 is a side sectional view showing a state in which the manual feed unit according to the second exemplary embodiment is closed.
Figure 9:
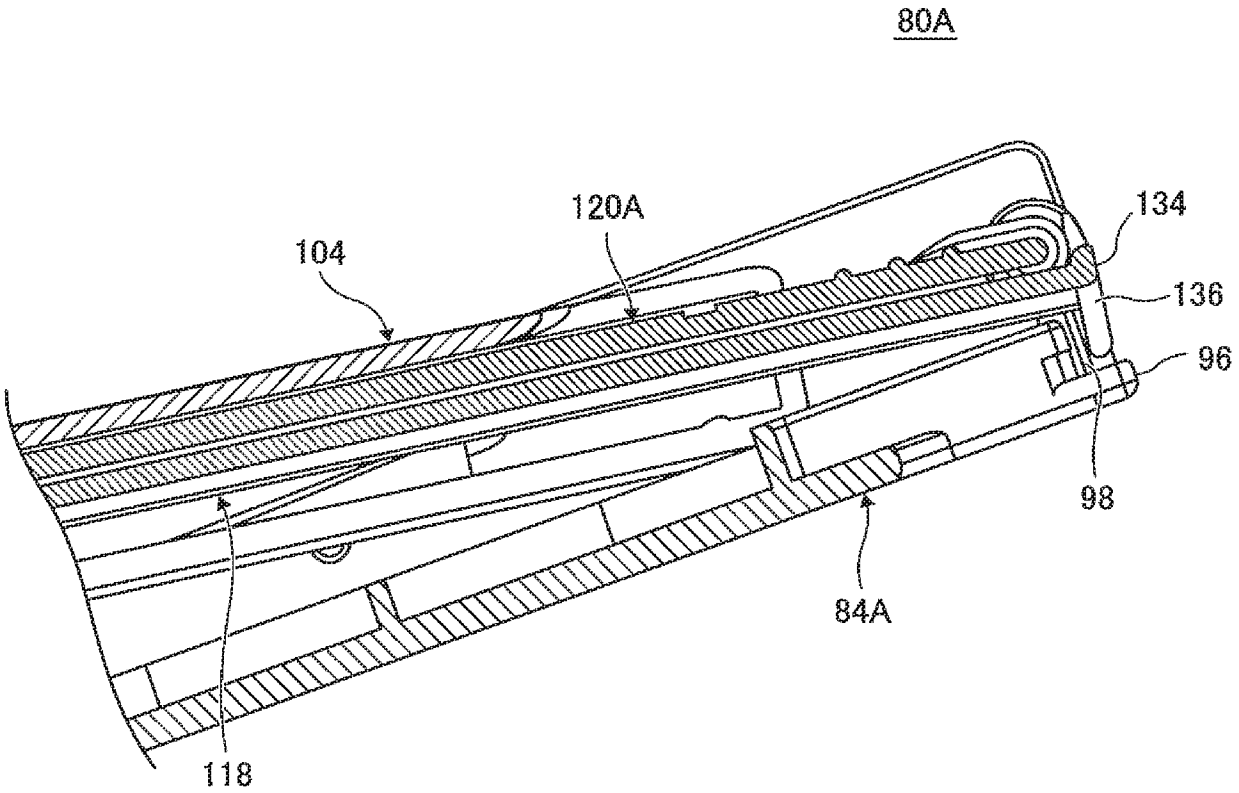
FIG. 9 is a side sectional view showing a state in which the manual feed unit according to the second exemplary embodiment is open.

Furthermore, as shown in FIGS. 7 to 9, the second engaging part 136 projecting toward the exterior member 84A is formed on the extension member 120A according to the second exemplary embodiment, at a distal end 134 of the extension member 120A. The second engaging part 136 is formed in the shape of a wall perpendicular to the extension member 120A. The second engaging part 136 is not formed on the portion corresponding to the cut-away portion 94 provided in the exterior member 84A, and that portion is open (see FIG. 10). Furthermore, the extension member 120A according to the second exemplary embodiment is not provided with a manipulating part, such as a manipulating hole or a manipulating projection provided in the extension member 120 according to the first exemplary embodiment.

When the exterior member 84A and the base member 104 are fitted together, the extension member 120A stored in the base member 104 is attached such that the second engaging part 136 at the distal end 134 is engaged with the first engaging part 98 of the exterior member 84A.

In this manual feed unit 80A according to the second exemplary embodiment, when the manual feed unit 80A is opened, the base member 104 is located below the exterior member 84A, as shown in FIG. 9. However, because the extension member 120A is opened with the second engaging part 136 being engaged with the first engaging part 98 of the exterior member 84A, the distal end 134 of the extension member 120A does not move to a position below the exterior member 84A, but is located at the same position as the distal end 96 of the exterior member 84A.

Figure 10:
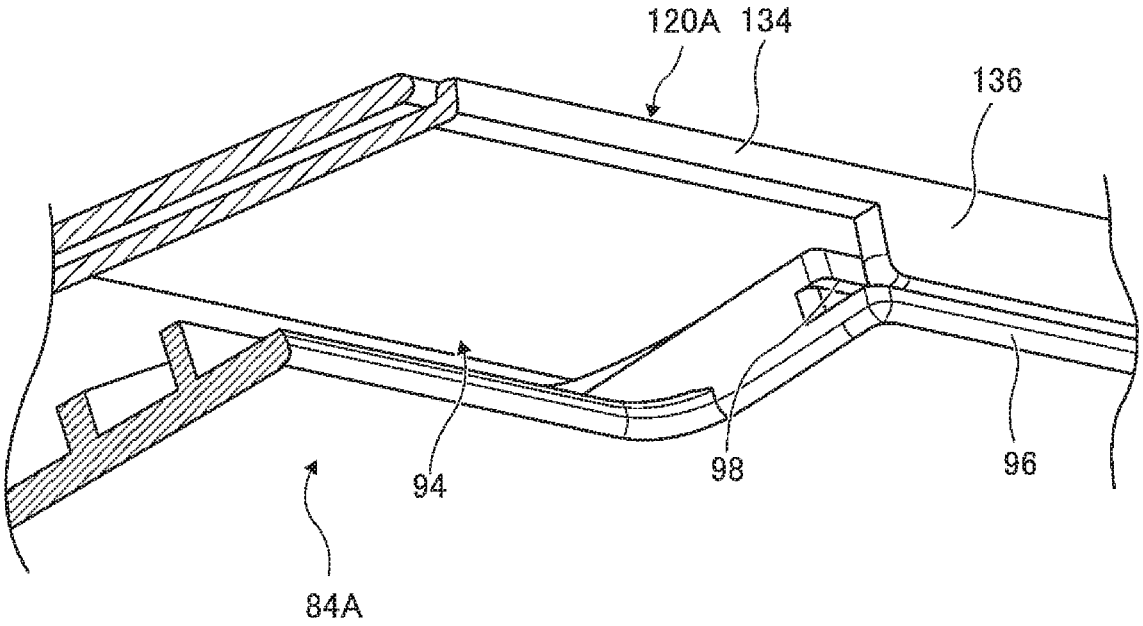
FIG. 10 is an enlarged perspective view of a distal end of an extension member according to the second exemplary embodiment.

Thereafter, the extension member 120A is pulled out. At this time, as shown in FIG. 10, the extension member 120A may be pulled out by holding a portion of the extension member 120A corresponding to the cut-away portion 94 provided in the exterior member 84A. In the extension member 120A according to the second exemplary embodiment, because it is possible to hold the extension member 120A through the cut-away portion 94 provided in the exterior member 84A, the manipulating part, such as one provided in the first exemplary embodiment, does not need to be formed.

Furthermore, in the manual feed unit 80A according to the second exemplary embodiment, when the second engaging part 136 of the extension member 120A is engaged with the first engaging part 98 of the exterior member 84A, the distal end 96 of the exterior member 84A is covered by the second engaging part 136 of the extension member 120A. Thus, the appearance is improved.

Third Exemplary Embodiment

Although the manual feed unit 80 of the image forming apparatus 10 according to the first exemplary embodiment is configured such that the extension member 120 is located below the distal end 96 of the exterior member 84 when the exterior member 84 is opened, a manual feed unit 80B of an image forming apparatus 10B according to a third exemplary embodiment is configured such that a proximal end side of the extension member 120B is supported by the exterior member 84B. Because the manual feed unit 80B according to the third exemplary embodiment differs from the manual feed unit 80 according to the first exemplary embodiment only in the configuration of part of the exterior member and extension member, the components common to those according to the first exemplary embodiment will be denoted by the same reference signs, and detailed descriptions thereof will be omitted.

Figure 11:
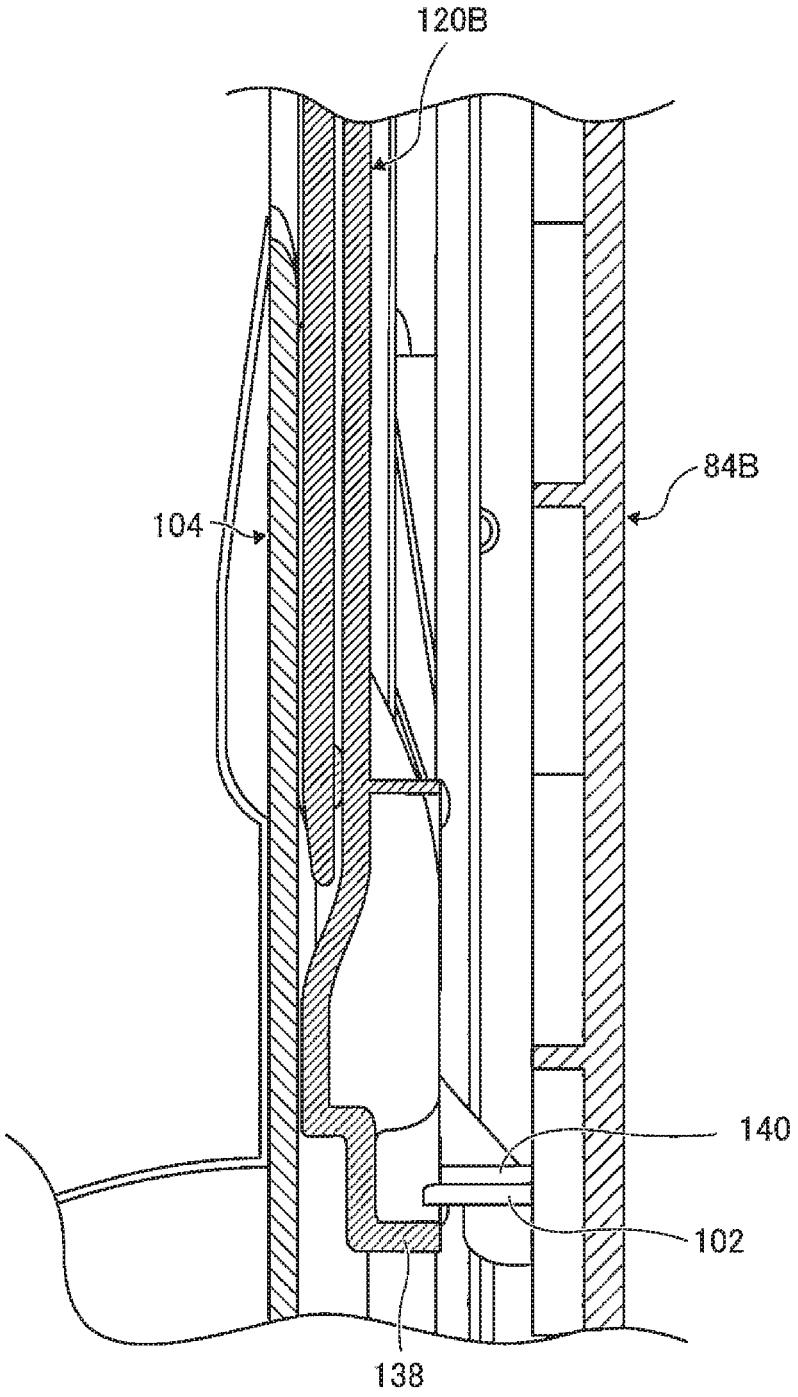
FIG. 11 is a side sectional view showing a state in which a manual feed unit according to the third exemplary embodiment is closed.
Figure 12:
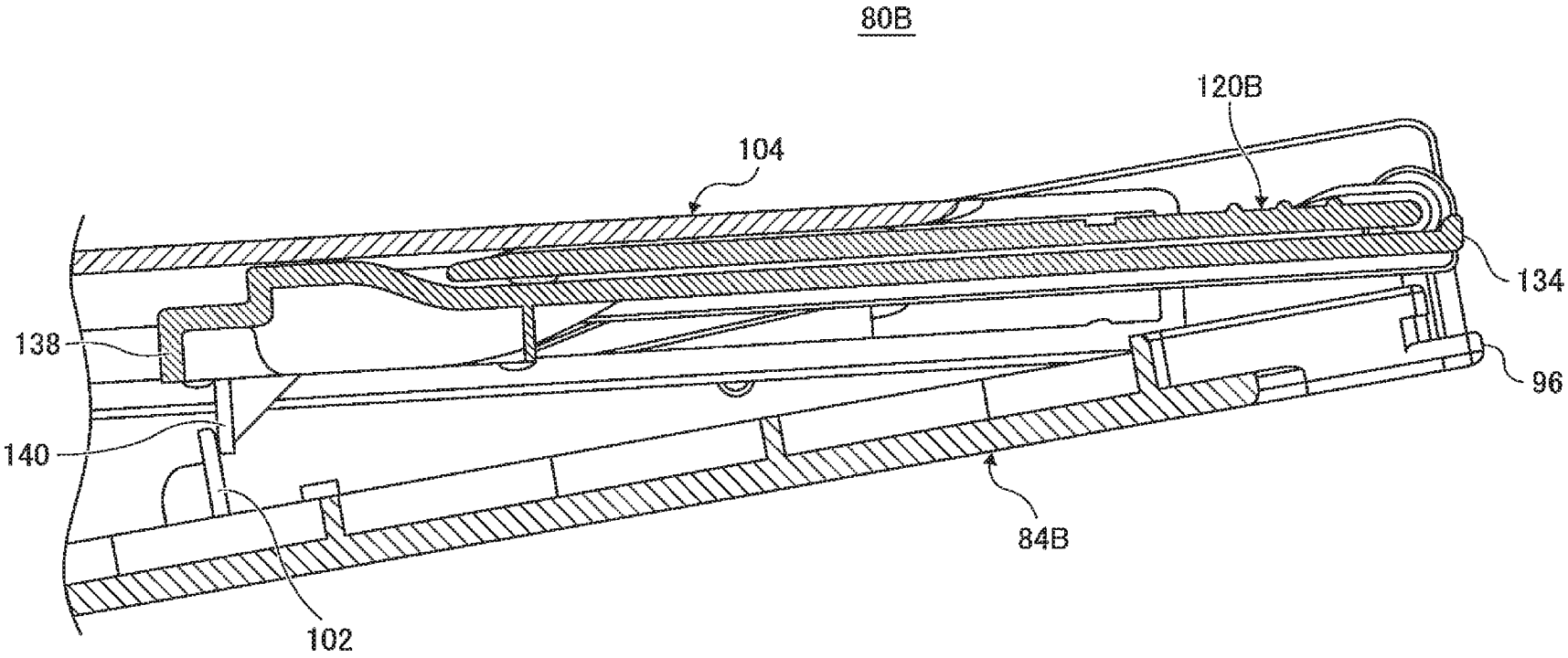
FIG. 12 is a side sectional view showing a state in which the manual feed unit according to the third exemplary embodiment is open.

The manual feed unit 80B of the image forming apparatus 10B according to the third exemplary embodiment will be described primarily with reference to FIGS. 11 and 12, and also to the drawings used in the description of the first and second exemplary embodiments. As shown in FIGS. 11 and 12, in the exterior member 84B according to the third exemplary embodiment, a wall-shaped support part 102 projecting toward the base member 104 is formed at a proximal end side 100 of the exterior member 84B, i.e., the side provided with the first shaft 90 (see FIG. 3).

Furthermore, in the extension member 120B according to the third exemplary embodiment, a support projection 140 projecting toward the exterior member 84B is formed at a proximal end side 138 of the extension member 120B, opposite from the distal end 134.

The support part 102 of the exterior member 84B and the support projection 140 of the extension member 120B are formed such that the distal end 134 of the extension member 120B and the distal end 96 of the exterior member 84B are located at the same position when the manual feed unit 80B is opened (see FIG. 11).

With this configuration, in the manual feed unit 80B according to the third exemplary embodiment, although the base member 104 is located below the exterior member 84B when the manual feed unit 80B is opened, because the extension member 120B is opened with the support projection 140 being supported by the support part 102 of the exterior member 84B, the distal end 134 of the extension member 120B is located at the same position as the distal end 96 of the exterior member 84B.

Thereafter, the extension member 120B is pulled out. At this time, by holding a portion of the extension member 120B corresponding to the cut-away portion 94 provided in the exterior member 84B, the extension member 120B may be pulled out (see FIG. 10). Because the extension member 120B according to the third exemplary embodiment may be held through the cut-away portion 94 provided in the exterior member 84B, the manipulating part, such as one provided in the first exemplary embodiment, does not need to be formed, as in the case of the second exemplary embodiment.

Fourth Exemplary Embodiment

Figure 13:
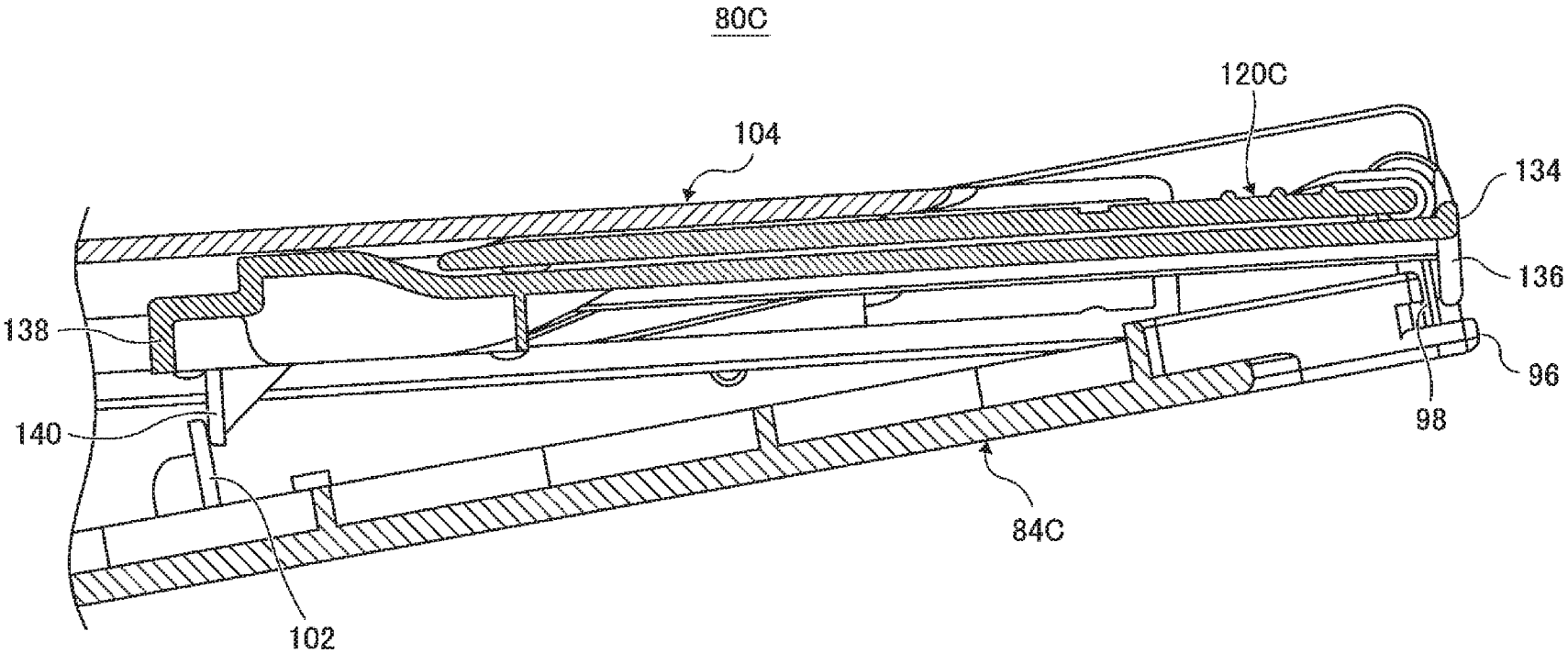
FIG. 13 is a side sectional view showing a state in which a manual feed unit according to the fourth exemplary embodiment is open.

A manual feed unit 80C of an image forming apparatus 100 according to a fourth exemplary embodiment will be described primarily with reference to FIG. 13, and also to the drawings used in the description of the first to third exemplary embodiments. As shown in FIG. 13, the manual feed unit 80C of the image forming apparatus 100 according to the fourth exemplary embodiment is provided with the second engaging part 136 of the exterior member 84A and the first engaging part 98 of the extension member 120A (see FIGS. 8 and 9) provided in the manual feed unit 80A according to the second exemplary embodiment, and the support part 102 of the exterior member 84B and the support projection 140 of the extension member 120B see (FIGS. 11 and 12) provided in the manual feed unit 80B according to the third exemplary embodiment. Because the configuration of part of the exterior member and extension member is common to that according to the second and third exemplary embodiments, and the configuration of the other part of the image forming apparatus is common to that of the first exemplary embodiment, the same components will be denoted by the same reference signs, and detailed descriptions thereof will be omitted.

As shown in FIG. 13, the first engaging part 98 projecting toward the base member 104 is formed on the exterior member 84C according to the fourth exemplary embodiment, at the distal end 96 thereof. The first engaging part 98 is formed perpendicularly to the exterior member 84C. Furthermore, the wall-shaped support part 102 perpendicularly projecting toward the extension member 120C is formed on the proximal end side 100, i.e., the side provided with the first shaft 90 (see FIG. 3), of the exterior member 84C.

Furthermore, as shown in FIG. 13, in the extension member 120C according to the fourth exemplary embodiment, the second engaging part 136 projecting toward the exterior member 84C is formed at the distal end 134 of the extension member 120C. Furthermore, the support projection 140 projecting toward the exterior member 84C is formed at the proximal end side 138 of the extension member 120C, opposite from the distal end 134.

With this configuration, in the manual feed unit 80C according to the fourth exemplary embodiment, although the base member 104 is located below the exterior member 84C when the manual feed unit 80C is opened, because the extension member 120C is opened with the first engaging part 98 being engaged with the second engaging part 136 at the distal end 134 of the exterior member 84C and with the support projection 140 being supported by the support part 102 at the proximal end side 138, the distal end 134 of the extension member 120C is located at the same position as the distal end 96 of the exterior member 84B.

Furthermore, in the manual feed unit 80C according to the fourth exemplary embodiment, because the second engaging part 136 of the extension member 120C is engaged with the first engaging part 98 of the exterior member 84C, the distal end 96 of the exterior member 84C is covered by the second engaging part 136 of the extension member 120C. Thus, the appearance is improved.

Thereafter, the extension member 120C is pulled out. At this time, by holding a portion of the extension member 120C corresponding to the cut-away portion 94 provided in the exterior member 84C, the extension member 120C may be pulled out (see FIG. 10). In the extension member 120C according to the fourth exemplary embodiment, because it is possible to hold the extension member 120C through the cut-away portion 94 in the exterior member 84C, the manipulating part, such as one provided in the first exemplary embodiment, does not need to be formed, as in the case of the second and third exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising an opening and closing unit attached to an image forming apparatus body, wherein the opening and closing unit comprises:

an exterior member pivotably attached to the image forming apparatus body via a first shaft;

a base member provided inside the exterior member and pivotably attached to the image forming apparatus body via a second shaft so as to be able to move with the exterior member; and an extension member attached to the base member in a manner capable of being pulled out and retracted, wherein a first engaging part projecting toward the extension member is formed on the exterior member, at a distal end thereof opposite from the first shaft, a second engaging part projecting toward the exterior member is formed on the extension member, at a distal end thereof facing the distal end of the exterior member, and, when the opening and closing unit is opened and closed, the first engaging part of the exterior member engages with the second engaging part of the extension member, moving the extension member, wherein a support part projecting toward the extension member is formed on the exterior member, at a first shaft side thereof, a support projection projecting toward the exterior member is formed on the extension member, at a side opposite from the distal end thereof, and, when the opening and closing unit is opened and closed, the support part of the exterior member supports the support projection of the extension member, moving the extension member.

2. The image forming apparatus according to claim 1, wherein the extension member is disposed inside the base member, and the extension member is pulled out and retracted linearly along the base member.

3. The image forming apparatus according to claim 2, wherein a manipulating part is formed on the extension member, at a side from which the extension member is pulled out.

4. The image forming apparatus according to claim 1, wherein a manipulating part is formed on the extension member, at a side from which the extension member is pulled out.

* * * * *